US011476600B2

(12) United States Patent
Price et al.

(10) Patent No.: US 11,476,600 B2
(45) Date of Patent: Oct. 18, 2022

(54) ELECTRICAL TERMINALS WITH OFFSET SUBSTRATE MATING PORTIONS

(71) Applicant: TE Connectivity Services GmbH, Schaffhausen (CH)

(72) Inventors: Matthew G. Price, Winston Salem, NC (US); Galen M. Martin, Mechanicsburg, PA (US); Matthew Bryan Hitchcock, Hershey, PA (US); James Edward Gundermann, Lebanon, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/126,200

(22) Filed: Dec. 18, 2020

(65) Prior Publication Data

US 2022/0200175 A1 Jun. 23, 2022

(51) Int. Cl.

| | |
|---|---|
| ***H01R 12/58*** | (2011.01) |
| ***H01R 12/70*** | (2011.01) |
| ***H01R 13/05*** | (2006.01) |
| ***H01R 12/73*** | (2011.01) |
| *H01R 107/00* | (2006.01) |

(52) U.S. Cl.

CPC ..... *H01R 12/585* (2013.01); *H01R 12/7005* (2013.01); *H01R 12/73* (2013.01); *H01R 13/05* (2013.01); *H01R 2107/00* (2013.01)

(58) Field of Classification Search

CPC ..... H01R 12/585; H01R 43/205; H01R 12/7005; H01R 12/73; H01R 13/05; H01R 2107/00

USPC ..... 439/943, 82, 751, 891

See application file for complete search history.

(56) References Cited

U.S. PATENT DOCUMENTS

| | | | | | |
|---|---|---|---|---|---|
| 4,089,104 | A * | 5/1978 | Barry | H01R 43/205 | 29/739 |
| 4,332,431 | A * | 6/1982 | Bobb | H01R 12/88 | 439/267 |
| 4,372,040 | A * | 2/1983 | Wickham | B23P 19/00 | 29/741 |
| 4,619,495 | A * | 10/1986 | Sochor | H01R 12/585 | 439/637 |
| 4,834,673 | A * | 5/1989 | Beinhaur | H01R 12/675 | 439/422 |
| 5,139,446 | A * | 8/1992 | Costello | H01R 13/42 | 439/751 |
| 5,675,891 | A * | 10/1997 | Childs | B23K 1/002 | 29/879 |
| 5,951,340 | A * | 9/1999 | Mueller | H01R 25/161 | 439/891 |

(Continued)

*Primary Examiner* — Gary F Paumen

(57) ABSTRACT

An electrical terminal for use with an electrical connector which includes a housing for receiving the electrical terminals therein. The electrical terminals have transition portions and substrate mating portions. The transition portions extend from a rear face of the housing. The substrate mating portions extend from the transition portions. The substrate mating portions have substrate engagement ends configured to be inserted into openings of a substrate. Shoulders are provided on the substrate mating portions. The shoulders are in a different plane than a longitudinal axis of the transition portions. Wherein forces associated with mating the electrical terminals to the substrate are transferred through the shoulders to an insertion tool used to move the terminals into the openings.

13 Claims, 8 Drawing Sheets

(56) References Cited

U.S. PATENT DOCUMENTS

| | | | | |
|---|---|---|---|---|
| 6,004,172 | A * | 12/1999 | Kerek | H01R 13/10 439/879 |
| 6,290,556 | B1 * | 9/2001 | Howland | H01R 4/188 439/879 |
| 7,252,559 | B1 * | 8/2007 | Morello | H01R 4/185 439/843 |
| 8,727,815 | B1 * | 5/2014 | Mongold | H01R 12/585 439/751 |
| 9,331,400 | B1 * | 5/2016 | Bianca | H01R 13/05 |
| 2006/0141831 | A1 * | 6/2006 | Hsu | H01R 13/41 439/108 |
| 2007/0049132 | A1 * | 3/2007 | Uchida | H01R 13/113 439/891 |
| 2007/0099448 | A1 * | 5/2007 | Taylor | H05K 3/326 439/73 |
| 2010/0093209 | A1 * | 4/2010 | Liu | H01R 13/518 439/541.5 |
| 2013/0109246 | A1 * | 5/2013 | Minich | H01R 4/48 439/682 |
| 2014/0098508 | A1 * | 4/2014 | Dunham | H01R 12/716 361/791 |

* cited by examiner

ELECTRICAL TERMINALS WITH OFFSET SUBSTRATE MATING PORTIONS

FIELD OF THE INVENTION

The present invention is directed electrical terminals with substrate mating portions. In particular, the invention is directed to electrical terminals with offset substrate mating portions to allow the substrate mating portions to be supported during insertion into a substrate.

BACKGROUND OF THE INVENTION

It is common practice to make an electrical connection to a printed circuit board by means of an electrical header assembly which comprises a dielectric housing and a plurality of conductor terminals or pins. The terminals or pins have substrate engagement sections for electrical connection to the substrate or printed circuit board when the header assembly is attached. The substrate or printed circuit board has a precise pattern of holes which receives the substrate engagement sections which are then soldered or otherwise secured to the substrate or printed circuit board to provide a good electrical interface.

If the substrate engagement sections have compliant contact portions, the insertion of the substrate engagement sections into the openings of the printed circuit board requires force to be applied to the compliant portions. With known header assemblies, the application of the force to an array of terminals or pins with compliant contact portions is difficult, due to the configuration of the terminals or pins and the close centerline spacing therebetween.

It would be beneficial to provide electrical terminals with substrate mating portions which allow for an array of terminals to be inserted into openings in a substrate simultaneously. In particular, it would be beneficial to provide terminals with offset compliant pin sections to allow the compliant portions to be supported during insertion into a substrate.

SUMMARY OF THE INVENTION

An embodiment is directed to an electrical terminal for use in an electrical connector. The electrical terminal includes a connector mating portion which is configured to be positioned in a housing of the electrical connector. A transition portion extends from the connector mating portion. A substrate mating portion extends from a second end of the transition portion. The substrate mating portion has a substrate engagement end provided at a free end of the substrate mating portion. The substrate mating portion is configured to be inserted into an opening of a substrate. A shoulder is provided on the substrate mating portion, the shoulder has a shoulder engagement surface which is spaced from the substrate engagement end. The shoulder engagement surface is in a different plane than a longitudinal axis of the transition portion. As the substrate engagement end of the substrate mating portion is inserted in the opening, the shoulder engagement surface of the shoulder of the substrate mating portions engages an insertion tool, wherein forces associated with mating the electrical terminal to the substrate are transferred through the shoulder to the insertion tool.

An embodiment is directed to an electrical connector which includes a housing for receiving electrical terminals therein. The electrical terminals have transition portions and substrate mating portions. The transition portions are positioned in the housing. The substrate mating portions extend from the transition portions. The substrate mating portions have substrate engagement ends configured to be inserted into openings of a substrate. Shoulder engagement surfaces are provided on the substrate mating portions. The shoulder engagement surfaces are in a different plane than a longitudinal axis of the transition portions. Wherein forces associated with mating the electrical terminals to the substrate are transferred through the shoulder engagement surfaces to an insertion tool used to move the terminals into the openings.

An embodiment is directed to an electrical connector having a housing with electrical terminals positioned therein. The electrical terminals have connector mating portions which are configured to be positioned in the housing of the electrical connector. Transition portions extend from the connector mating portions. Substrate mating portions extend from the transition portions. The substrate mating portions have substrate engagement ends provided at free ends of the substrate mating portions. The substrate mating portions are configured to be inserted into openings of a substrate. Shoulders are provided on the substrate mating portions. The shoulders have shoulder engagement surfaces which are spaced from the substrate engagement ends. The shoulder engagement surfaces extend from the front surface in a direction away from the rear surface, wherein the shoulders are in a different plane than a longitudinal axis of the transition portions. As the substrate engagement ends of the substrate mating portions are inserted in the openings, the shoulder engagement surfaces of the shoulders of the substrate mating portions are engaged by an insertion tool, wherein forces associated with mating the electrical terminals to the substrate are transferred through the shoulders to the insertion tool.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
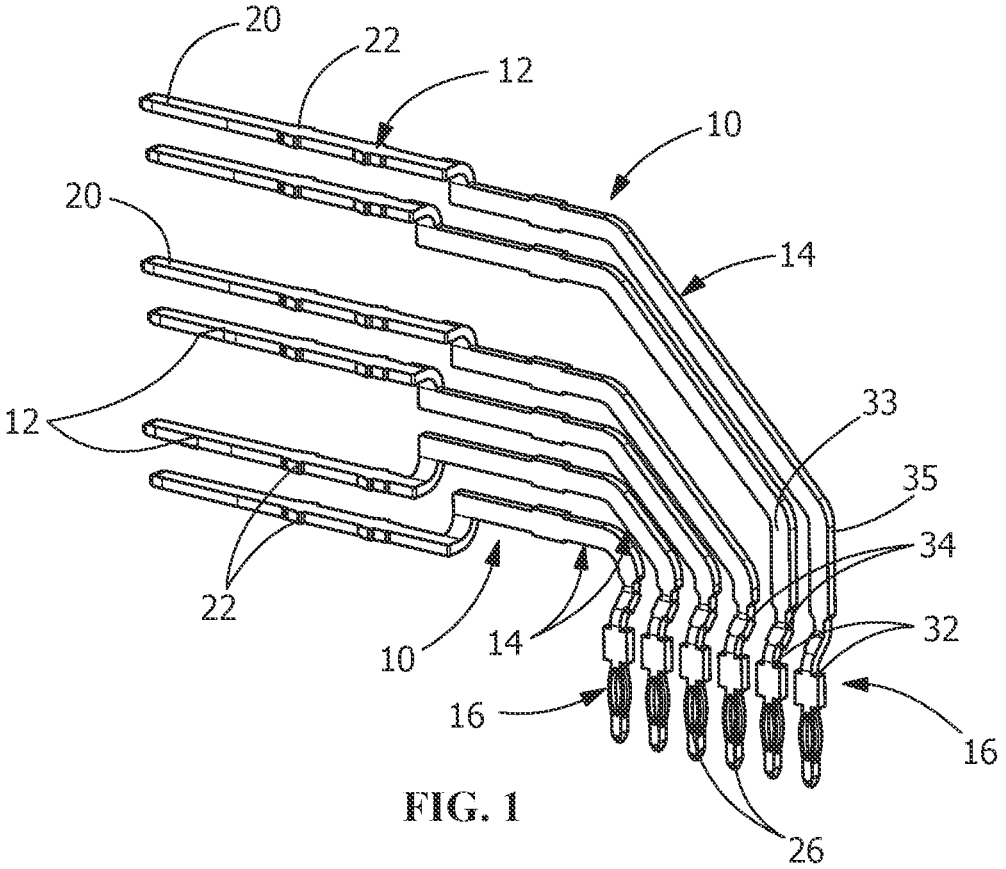
FIG. 1 is a perspective view of illustrative electrical terminals with insertion support sections according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in the illustrative embodiment shown in FIG. 1 through 4, contacts or terminals 10 have connector mating portions 12, transition portions 14 and substrate mating portions 16. In FIG. 1, six different terminals 10 are shown with different transition portions 14. However, other configurations of the terminals 10 can be used.

The connector mating portions 12 have mating ends 20 which are configured to mate with mating terminals (not shown) of a mating connector (not shown). The connector mating portions 12 have securing projections 22, such as, but not limited to, barbs, which are spaced from the mating ends 20. In the illustrative embodiment shown, the connector mating portions 12 are bent relative to the transition portions 14, whereby the longitudinal axis of the connector mating portions 12 is in a different plane than the longitudinal axis of the transition portions 14. However, other orientations of the connector mating portions 12 relative to the transition portions 14 may be used.

The transition portions 14 extend between the connector mating portions 12 and the substrate mating portions 16. The configuration and length of the transition portions 14 may vary depending on the configuration of the connector housing 40 into which the terminals 10 are positioned.

Figure 2:
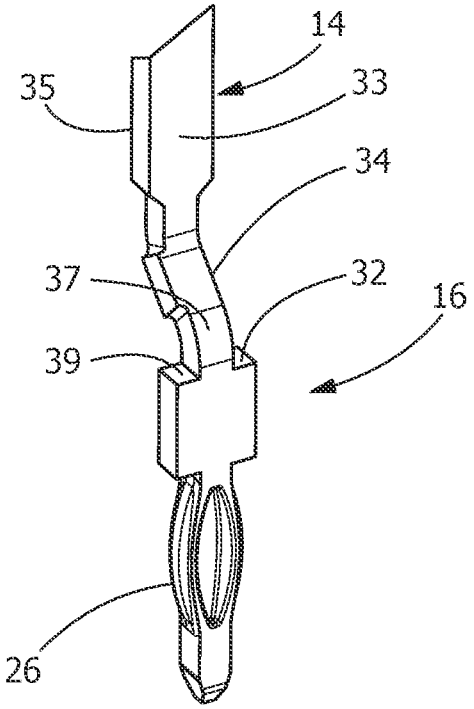
FIG. 2 is an enlarged perspective view of the insertion support section of an electrical terminal shown in FIG. 1.
Figure 3:
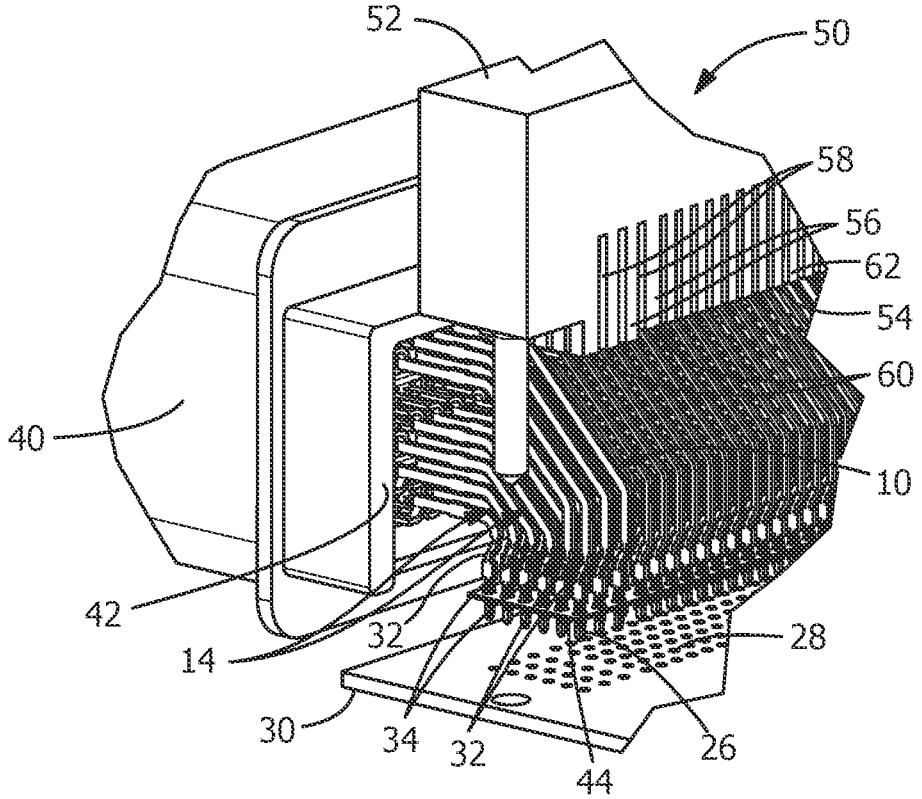
FIG. 3 is a perspective view of an illustrative header with the electrical terminals of FIG. 1 inserted therein, insertion tooling is positioned proximate to the electrical terminals.
Figure 4:
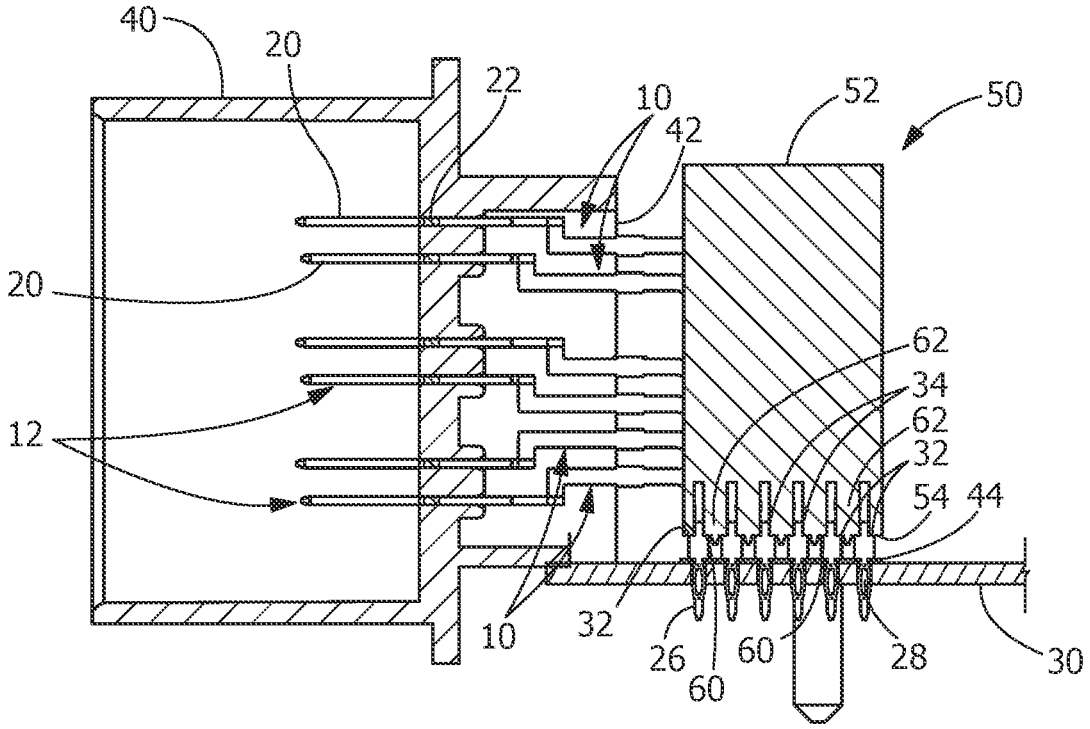
FIG. 4 is a cross-sectional view of the header of FIG. 3 with the insertion tooling in mechanical engagement with the insertion support sections of the electrical terminals.

As shown in FIGS. 1 and 2, the substrate mating portions 16 have substrate engagement ends 26 which are provided at free ends of the substrate mating portions and are configured to be inserted into through holes or openings 28 of a substrate or printed circuit board 30 (FIGS. 3 and 4). In the embodiment shown, the substrate engagement ends 26 are compliant pins, such as for example, eye of the needle compliant pins. However, other type configuration can be used for the substrate engagement ends 26. The substrate mating portions 16 have shoulders 32 spaced from the substrate engagement ends 26. The shoulders 32 have shoulder engagement surfaces 39 which are essentially perpendicular to a front surface 33 of the transition portion 14. Angled members 34 extend between the shoulders 32 and the transition portions 14, whereby the longitudinal axis of the substrate mating portions 16 is in a different plane than the longitudinal axis of the transition portions 14. The angled members 34 may be, but are not limited to, curved or arcuate members. The shoulders 32 and the shoulder engagement surfaces 39 are in a different plane than the longitudinal axis of the transition portions 14. The shoulders 32 and the shoulder engagement surfaces 39 are positioned in-line or proximate to in-line with the substrate engagement ends 26.

As shown in FIG. 2, the thickness of material of each terminal 10 and the transition portion 14 is constant and extends between the front surface 33 and the rear surface 35. Each angled member 34, which has the same thickness of the transition portion 14 extends at an angle from the transition portion 14, wherein an end 37 of the transition member 34 is positioned outside a plane of the transition portion 14. As the substrate mating portion 16 extends from the end 37 of the transition member 34, the substrate mating portion 16, including the shoulders 32 and the shoulder engagement surfaces 39, is positioned outside of the plane of the transition portion 14.

Referring to FIG. 3, the terminals 10 are shown inserted into the housing 40. When fully inserted into the housing 40, the securing projections 22 of the connector mating portions 12 engage the walls of the housing 40 to properly position and maintain the connector mating portions of the terminals 10 in the housing.

In this position, portions of the transition portions 14 and the substrate mating portions 16 extend from a rear face 42 of the housing 40. Respective substrate engagement ends 26 of the terminals 10 are spaced from other respective substrate engagement ends 26. As shown in FIG. 3, the substrate engagement ends 26 form a pattern which corresponds the pattern of the through holes or openings 28 of the substrate or printed circuit board 30. An alignment member 44 cooperates with the substrate mating portions 16 to retain the substrate mating portions 16 in proper position until the substrate mating portions 16 are inserted into the substrate or printed circuit board 30.

As shown in FIG. 3, an insertion tool 50 is provided above the transition portions 14 and the substrate mating portions 16 of the terminals 10. The insertion tool 50 has a top surface 52 and an oppositely facing bottom surface 54. Terminal insertion projections 56 extend from the bottom surface 54 toward the top surface 52. The terminal insertion projections 56 are spaced apart by terminal receiving slots 58 which are dimensioned to receive the transition portions 14 of the terminals 10 therein. The terminal insertion projections 56 have engagement surfaces 60 provided at free ends 62 thereof which are positioned at the bottom surface 54. The engagement surfaces 60 are positioned to engage and cooperate with the shoulder engagement surfaces 39 of the substrate mating portions 16 of the terminals 10, as will be more fully described.

With the terminals 10 properly inserted into the housing 40 and the substrate engagement ends 26 properly positioned in-line with the through holes or openings 28 of the substrate or printed circuit board 30, the insertion tool 50 is moved from the initial position shown in FIG. 3 to the final position shown in FIG. 4.

In the initial position shown in FIG. 3, the terminal receiving slots 58 are aligned vertically with the transition portions 14 of the terminals. The terminal receiving slots 58 are dimensioned to be slightly wider than the width of the transition portions 14 of the terminals 10.

As the movement from the initial to the final position occurs, the terminal receiving slots 58 are moved over the transition portions 14 of the terminals 10. As the movement continues, the engagement surfaces 60 of the terminal insertion projections 56 are moved into engagement with the shoulder engagement surfaces 39 of the substrate mating portions 16. As the angled members 34 extend outside of the plane of the transition portions 14, the engagement surfaces 60 of the terminal insertion projections 56 of the insertion tool 50 are able to engage the shoulder engagement surfaces 39 of the substrate mating portions 16 while the transition portions 14 are maintained in the terminal receiving slots 58 of the insertion tool 50.

With the engagement surfaces 60 of the terminal insertion projections 56 of the insertion tool 50 in engagement with the shoulder engagement surfaces 39 of the substrate mating portions 16, the continued movement of the insertion tool 50 toward the final position causes the substrate engagement ends 26 of the substrate mating portions 16 to be moved or pushed by the engagement surfaces 60 of the terminal insertion projections 56 of the insertion tool 50 into the through holes or openings 28 of the substrate or printed circuit board 30 which are aligned therewith, as shown in FIG. 4.

As the substrate engagement ends 26 of the substrate mating portions 16 of the terminals 10 are moved into the through holes or openings 28 of the substrate or printed circuit board 30, the substrate engagement ends 26 engage the walls of the through holes or openings 28 to provide a reliable electrical connection between the through holes or openings 28 and the terminals 10.

As the substrate engagement ends 26 of the substrate mating portions 16 are configured to either deform or exert pressure on the walls of the through holes or openings 28, the amount of force required to insert the terminals 10 in the through holes or openings 28 can be significant. It is, therefore, advantageous to provide a mechanism which protects the terminals 10 from damage and deformation as the substrate engagement ends 26 of the substrate mating portions 16 are inserted into the through holes or openings 28. The insertion tool 50 provides such a mechanism.

As the substrate engagement ends 26 of the substrate mating portions 16 are inserted in the through holes or openings 28, the shoulder engagement surfaces 39 of the substrate mating portions 16 of the terminals 10 engage the engagement surfaces 60 of the terminal insertion projections 56 of the insertion tool 50. In so doing, forces applied to the substrate mating portions 16 will be transferred to the insertion tool 50 through the engagement of the shoulder engagement surface 39 of the shoulders 32 with the engagement surfaces 60. Consequently, forces/stresses associated with mating the terminals 10 to the substrate or printed circuit board 30 are transferred to the insertion tool 50 rather than through the relatively weak bends of the transition portions 14 of the terminal 10.

The positioning of the shoulder engagement surfaces 39 of the substrate mating portions 16 of the terminals 10 outside the plane of the transition portions 14 allows the engagement surfaces 60 of the terminal insertion projections 56 of the insertion tool 50 to cooperate with the shoulder engagement surfaces 39 of the substrate mating portions 16 to ensure that a sufficient force can be applied to the terminals 10 to facilitate mating of the compliant terminals 10 to the circuit board 30. As the mating forces are transferred to the insertion tool 50, the terminals 10 are not damaged or deformed during mating, thereby providing a secure and reliable connection between the terminals 10 and the printed circuit board 30.

Figure 5:
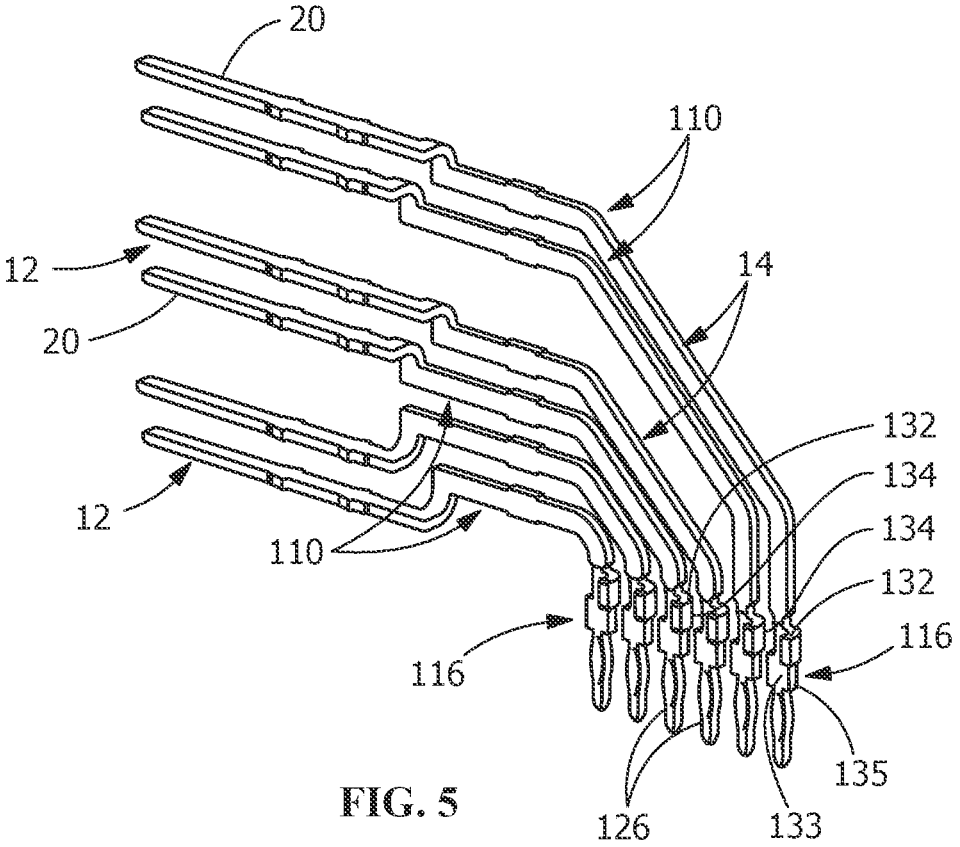
FIG. 5 is a perspective view of first alternate illustrative electrical terminals with insertion support sections according to the present invention.

As shown in the illustrative embodiment shown in FIG. 5 through 8, contacts or terminals 110 have connector mating portions 12, transition portions 14 and substrate mating portions 116. In FIG. 5, six different terminals 110 are shown with different transition portions 14. However, other configurations of the terminals 110 can be used. As the connector mating portions 12 and transition portions 14 are similar to those in FIGS. 1 through 4, the detailed description will not be repeated and is incorporated herein.

Figure 6:
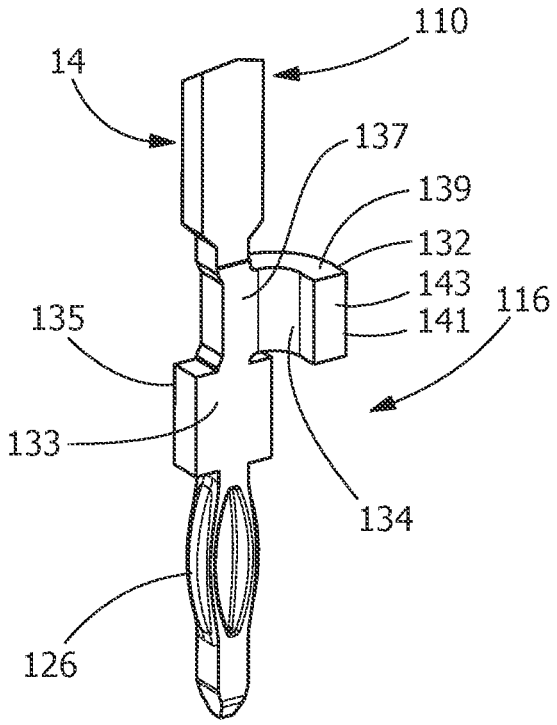
FIG. 6 is an enlarged perspective view of the insertion support section of an electrical terminal shown in FIG. 5.
Figure 7:
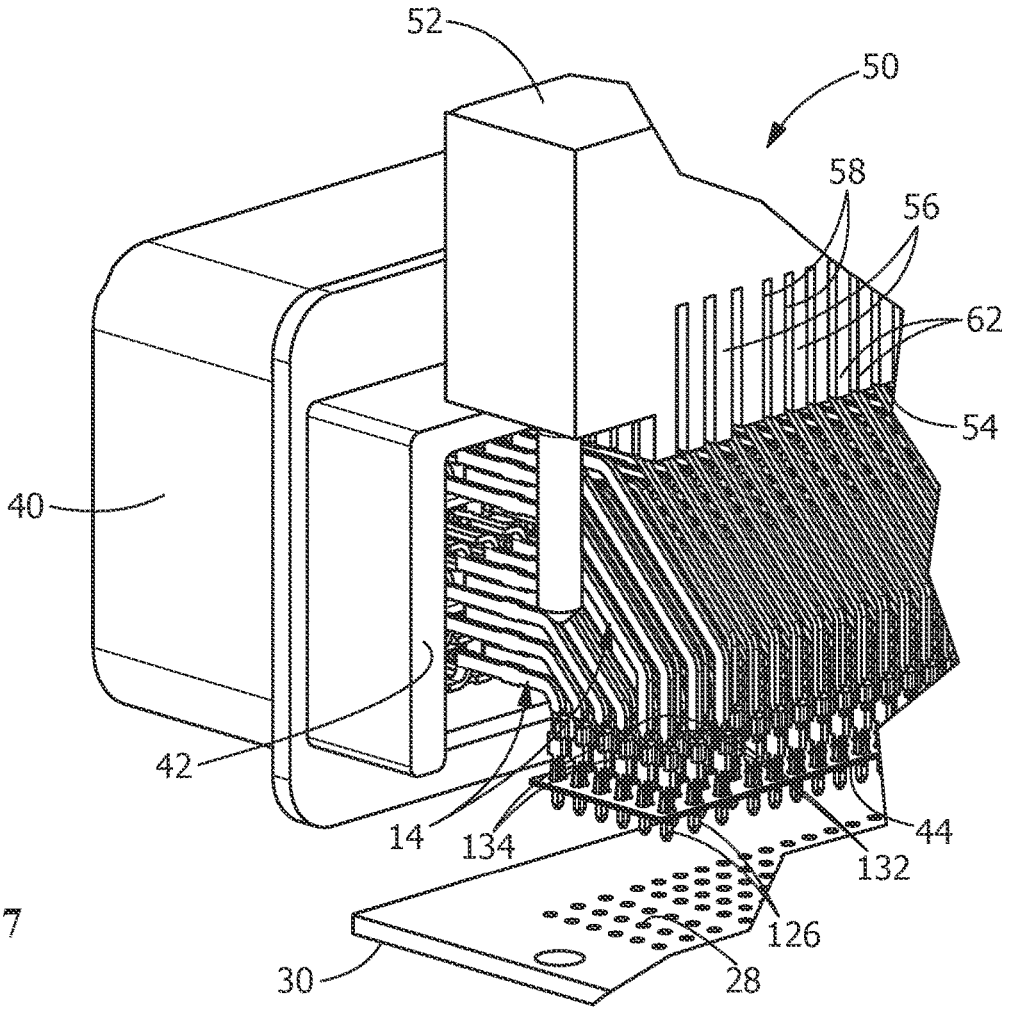
FIG. 7 is a perspective view of an illustrative header with the electrical terminals of FIG. 5 inserted therein, insertion tooling is positioned proximate to the electrical terminals.
Figure 8:
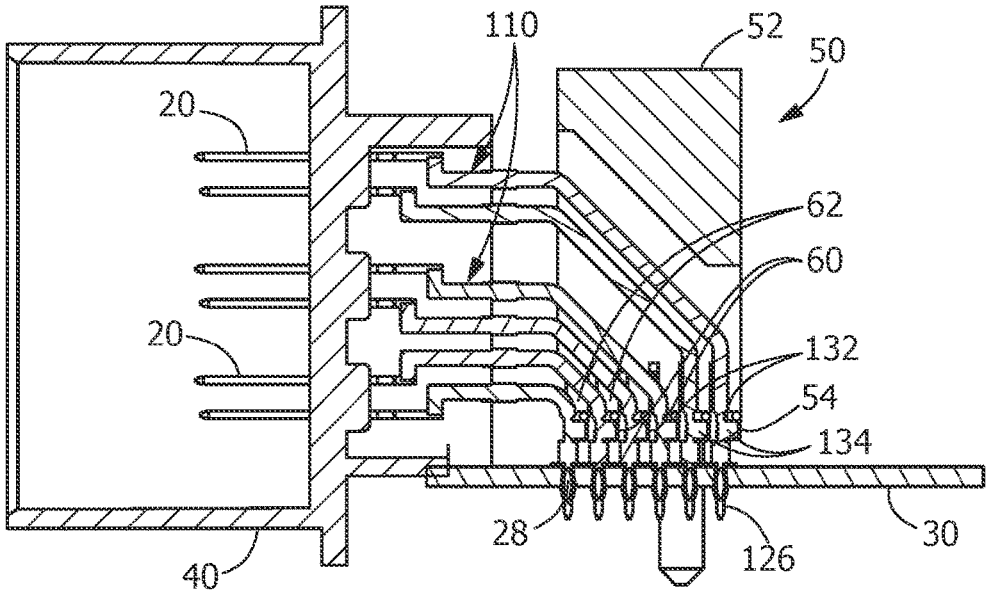
FIG. 8 is a cross-sectional view of the header of FIG. 7 with the insertion tooling in mechanical engagement with the insertion support sections of the electrical terminals.

As shown in FIGS. 5 and 6, the substrate mating portions 116 have substrate engagement ends 126 which are configured to be inserted into through holes or openings 28 of a substrate or printed circuit board 30 (FIGS. 7 and 8). In the embodiment shown, the substrate engagement ends 126 are compliant pins, such as for example, eye of the needle compliant pins. However, other type configuration can be used for the substrate engagement ends 126. The substrate mating portions 116 have projections 134 which extend from an intermediate portion 137 of the substrate mating portions 116. The projections 134 have shoulders 132 with shoulder engagement surfaces 139. The shoulder engagement surfaces 139 are spaced from the substrate engagement ends 126.

As shown in FIG. 6, each projection is bent so that a free end 141 of the projection 134 extends beyond the front surface 133 in a direction away from the rear surface 135. An end surface 143 of the free end 141 extends in a direction which is essentially parallel to the front surface 133. The shoulder engagement surface 139 is provided proximate the free end 141 of the projections 134.

As shown in FIG. 6, the thickness of material of each terminal 110 and the substrate mating portion 116 is constant and extends between the front surface 133 and the rear surface 135. Each projection 134, which is made from the same materials and has the same thickness of the substrate mating portion 116 is bent to have the free end 141 positioned outside a plane of the transition portion 14. Consequently, the shoulder engagement surface 139 is positioned outside a plane of the transition portion 14.

Referring to FIG. 7, the terminals 110 are shown inserted into the housing 40. When fully inserted into the housing 40, the securing projections 22 of the connector mating portions 12 engage the walls of the housing 40 to properly position and maintain the connector mating portions of the terminals 110 in the housing, as was previously described with respect to FIGS. 1 through 4.

As shown in FIG. 7, the insertion tool 50, as previously described, is provided above the transition portions 14 and the substrate mating portions 116 of the terminals 110. The engagement surfaces 60 of the insertion tool 50 are positioned to engage and cooperate with shoulder engagement surface 139 of the shoulders 132 of the projections 134, as will be more fully described.

With the terminals 110 properly inserted into the housing 40 and the substrate engagement ends 26 properly positioned in-line with the through holes or openings 28 of the substrate or printed circuit board 30, the insertion tool 50 is moved from the initial position shown in FIG. 7 to the final position shown in FIG. 8.

In the initial position shown in FIG. 7, the terminal receiving slots 58 are aligned vertically with the transition portions 14 of the terminals. The terminal receiving slots 58 are dimensioned to be slightly wider than the width of the transition portions 14 of the terminals 110.

As the movement from the initial to the final position occurs, the terminal receiving slots 58 are moved over the transition portions 14 of the terminals 110. As the movement continues, the engagement surfaces 60 of the terminal insertion projections 56 are moved into engagement with the shoulder engagement surface 139 of the substrate mating portions 116. As the shoulder engagement surfaces 139 extend outside of the plane of the transition portions 14, the engagement surfaces 60 of the terminal insertion projections 56 of the insertion tool 50 are able to engage the shoulder engagement surfaces 139 of the substrate mating portions 116 while the transition portions 14 are maintained in the terminal receiving slots 58 of the insertion tool 50.

With the engagement surfaces 60 of the terminal insertion projections 56 of the insertion tool 50 in engagement with the shoulder engagement surfaces 139 of the substrate mating portions 116, the continued movement of the insertion tool 50 toward the final position causes the substrate engagement ends 126 of the substrate mating portions 116 to be moved or pushed by the engagement surfaces 60 of the terminal insertion projections 56 of the insertion tool 50 into the through holes or openings 28 of the substrate or printed circuit board 30 which are aligned therewith.

As the substrate engagement ends 126 of the substrate mating portions 116 of the terminals 110 are moved into the through holes or openings 28 of the substrate or printed circuit board 30, the substrate engagement ends 126 engage the walls of the through holes or openings 28 to provide a reliable electrical connection between the through holes or openings 28 and the terminals 110.

As the substrate engagement ends 126 of the substrate mating portions 116 are configured to either deform or exert pressure on the walls of the through holes or openings 28, the amount of force required to insert the terminals 110 in the through holes or openings 28 can be significant. It is, therefore, advantageous to provide a mechanism which protects the terminals 110 from damage and deformation as the substrate engagement ends 126 of the substrate mating portions 116 are inserted into the through holes or openings 28. The insertion tool 50 provides such a mechanism.

As the substrate engagement ends 126 of the substrate mating portions 116 are inserted in the through holes or openings 28, the shoulder engagement surfaces 139 of the substrate mating portions 116 of the terminals 110 engage the engagement surfaces 60 of the terminal insertion projections 56 of the insertion tool 50. In so doing, forces applied to the substrate mating portions 116 will be transferred to the insertion tool 50 through the engagement of the shoulder engagement surfaces 139 of the shoulders 132 with the engagement surfaces 60. Consequently, forces/stresses associated with mating the terminals 110 to the substrate or printed circuit board 30 are transferred to the insertion tool 50 rather than through the relatively weak bends of the transition portions 14 of the terminal 110.

The positioning of the shoulder engagement surfaces 139 of the substrate mating portions 116 of the terminals 110 outside the plane of the transition portions 14 allows the engagement surfaces 60 of the terminal insertion projections 56 of the insertion tool 50 to cooperate with the shoulders 132 of the substrate mating portions 116 to ensure that a sufficient force can be applied to the terminals 110 to facilitate mating of the compliant terminals 110 to the circuit board 30. As the mating forces are transferred to the insertion tool 50, the terminals 110 are not damaged or deformed during mating, thereby providing a secure and reliable connection between the terminals 110 and the printed circuit board 30.

Figure 9:
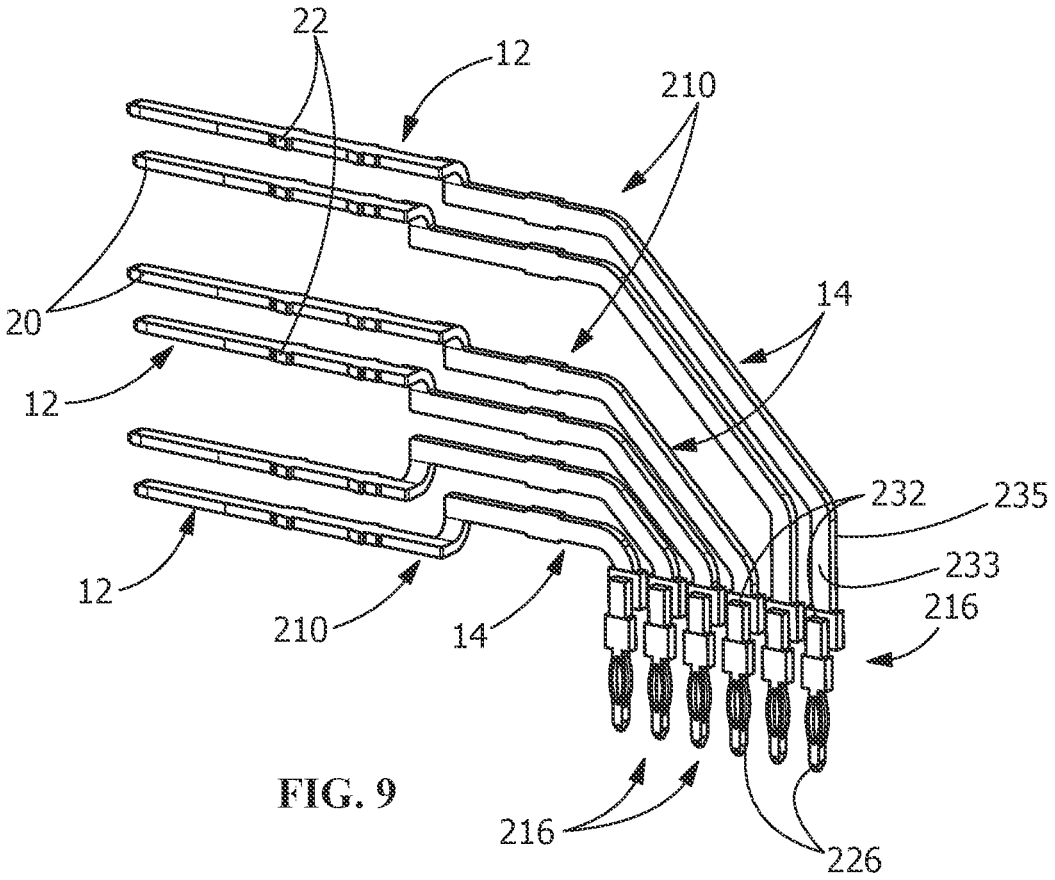
FIG. 9 is a perspective view of second alternate illustrative electrical terminals with insertion support sections according to the present invention.

As shown in the illustrative embodiment shown in FIG. 9 through 12, contacts or terminals 210 have connector mating portions 12, transition portions 14 and substrate mating portions 216. In FIG. 9, six different terminals 210 are shown with different transition portions 14. However, other configurations of the terminals 210 can be used. As the connector mating portions 12 and transition portions 14 are similar to those in FIGS. 1 through 4, the detailed description will not be repeated and is incorporated herein.

Figure 10:
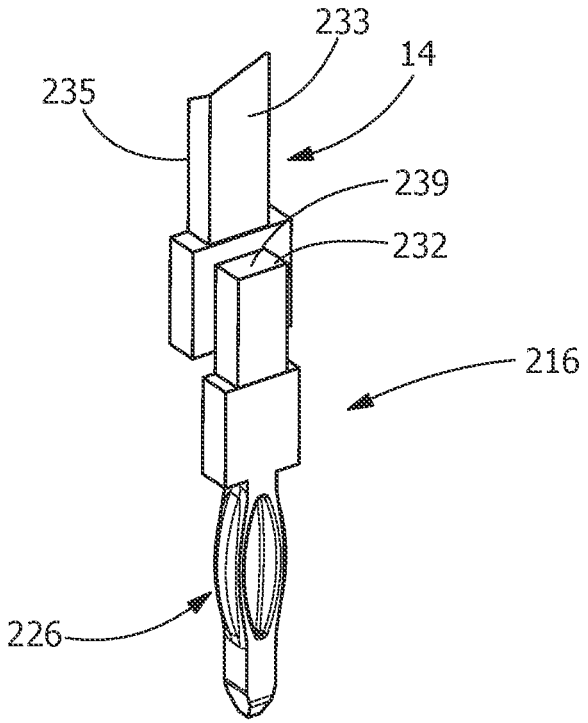
FIG. 10 is an enlarged perspective view of the insertion support section of an electrical terminal shown in FIG. 9.
Figure 11:
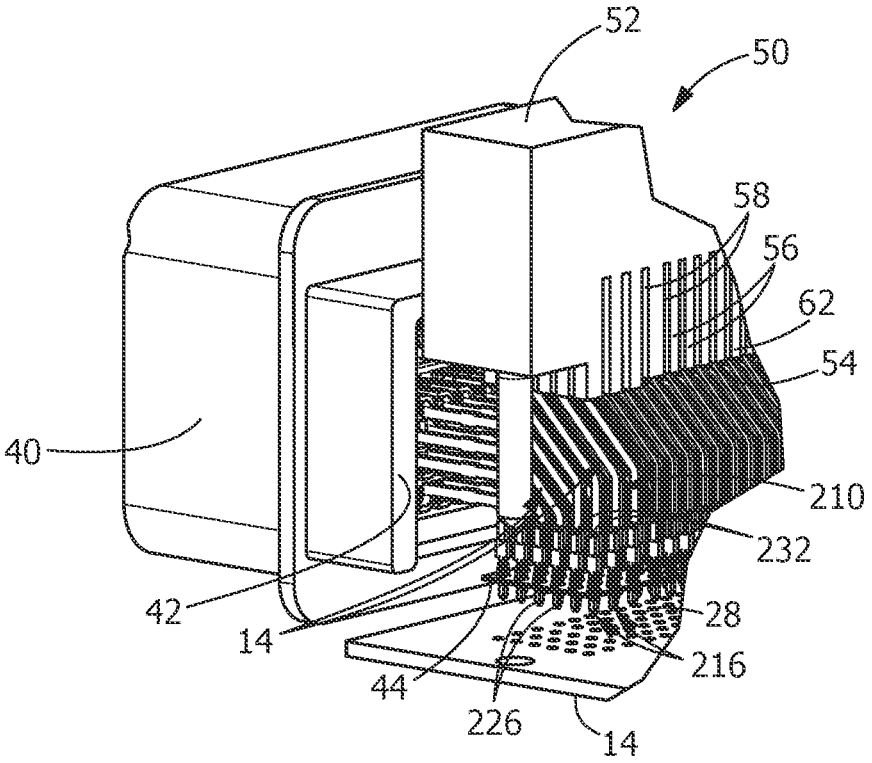
FIG. 11 is a perspective view of an illustrative header with the electrical terminals of FIG. 6 inserted therein, insertion tooling is positioned proximate to the electrical terminals.
Figure 12:
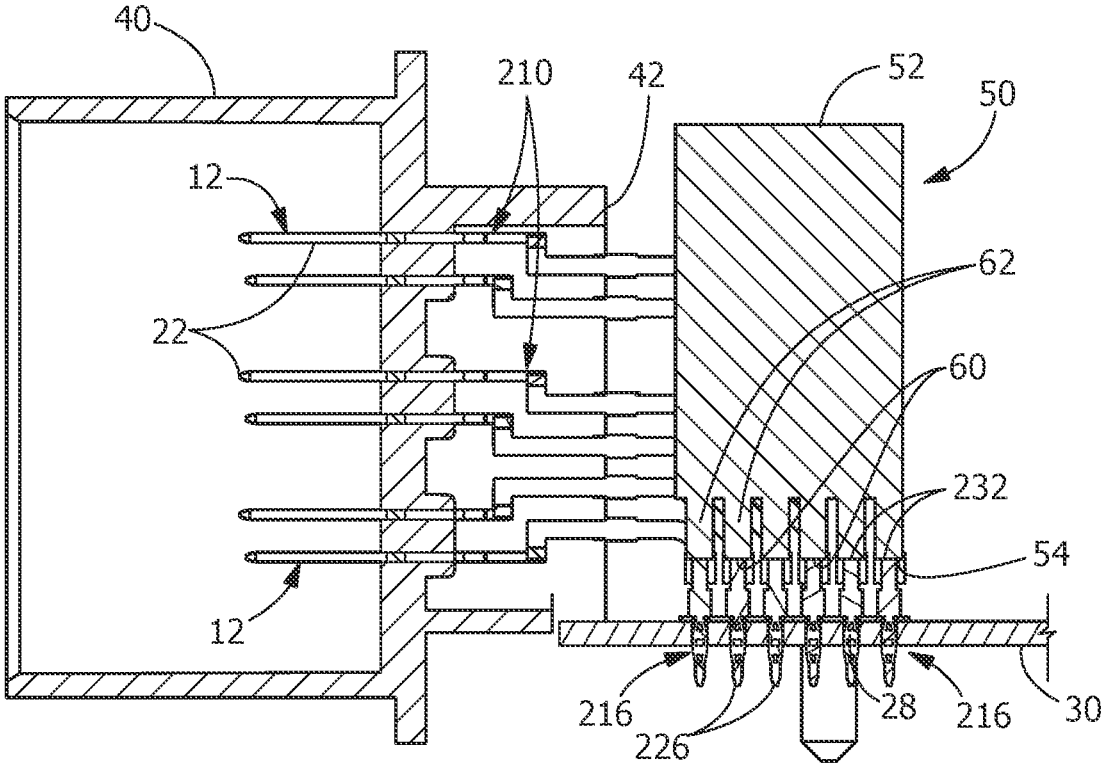
FIG. 12 is a cross-sectional view of the header of FIG. 11 with the insertion tooling in mechanical engagement with the insertion support sections of the electrical terminals.

As shown in FIGS. 9 and 10, the substrate mating portions 216 have substrate engagement ends 226 which are configured to be inserted into through holes or openings 28 of a substrate or printed circuit board 30 (FIGS. 11 and 12). In the embodiment shown, the substrate engagement ends 226 are compliant pins, such as for example, eye of the needle compliant pins. However, other type configuration can be used for the substrate engagement ends 226. The substrate mating portions 216 have shoulders 232 spaced from the substrate engagement ends 226. The shoulders 232 are provided in line with the substrate engagement ends 226 but are provided in a different plane than the longitudinal axis of the transition portions 14. The shoulders 232 extend from a front surface 233 of the substrate mating portions 216 in a direction away from a rear surface 235 of the substrate mating portions 216. The shoulders 232 have shoulder engagement surfaces 239 which extend in a direction which is essentially perpendicular to the front surface 233. In this embodiment, the substrate mating portions 216 are soldered or welded on to the transition portions 14, allowing the transitions portions 14 and the substrate mating portions 216 to be made of different materials.

As shown in FIG. 10, the thickness of material of each terminal 210 and the transition portion 14 is constant and extends between the front surface 233 and the rear surface 235. Each substrate mating portion 216 which is attached to a respective front surface 233 of the respective transition portion 14 extends outside a plane of the transition portion 14. Consequently, the shoulder 232 and the shoulder engagement surface 239 are positioned outside a plane of the transition portion 14.

Referring to FIG. 11, the terminals 210 are shown inserted into the housing 40. When fully inserted into the housing 40, the securing projections 22 of the connector mating portions 12 engage the walls of the housing 40 to properly position and maintain the connector mating portions of the terminals 210 in the housing, as was previously described with respect to FIGS. 1 through 4.

As shown in FIG. 11, the insertion tool 50, as previously described, is provided above the transition portions 14 and the substrate mating portions 216 of the terminals 210. The engagement surfaces 60 of the insertion tool 50 are positioned to engage and cooperate with the shoulder engagement surfaces 239 of the substrate mating portions 216 of the terminals 210, as will be more fully described.

With the terminals 210 properly inserted into the housing 40 and the substrate engagement ends 26 properly positioned in-line with the through holes or openings 28 of the substrate or printed circuit board 30, the insertion tool 50 is moved from the initial position shown in FIG. 11 to the final position shown in FIG. 12.

In the initial position shown in FIG. 11, the terminal receiving slots 58 are aligned vertically with the transition portions 14 of the terminals. The terminal receiving slots 58 are dimensioned to be slightly wider than the width of the transition portions 14 of the terminals 210.

As the movement from the initial to the final position occurs, the terminal receiving slots 58 are moved over the transition portions 14 of the terminals 210. As the movement continues, the engagement surfaces 60 of the terminal insertion projections 56 are moved into engagement with the shoulder engagement surfaces 239 of the substrate mating portions 216. As the shoulder engagement surfaces 239 extend outside of the plane of the transition portions 14, the engagement surfaces 60 of the terminal insertion projections 56 of the insertion tool 50 are able to engage the shoulder engagement surfaces 239 of the substrate mating portions 216 while the transition portions 14 are maintained in the terminal receiving slots 58 of the insertion tool 50.

With the engagement surfaces 60 of the terminal insertion projections 56 of the insertion tool 50 in engagement with the shoulder engagement surfaces 239 of the substrate mating portions 216, the continued movement of the insertion tool 50 toward the final position causes the substrate engagement ends 226 of the substrate mating portions 216 to be moved or pushed by the engagement surfaces 60 of the terminal insertion projections 56 of the insertion tool 50 into the through holes or openings 28 of the substrate or printed circuit board 30 which are aligned therewith.

As the substrate engagement ends 226 of the substrate mating portions 216 of the terminals 210 are moved into the through holes or openings 28 of the substrate or printed circuit board 30, the substrate engagement ends 226 engage the walls of the through holes or openings 28 to provide a reliable electrical connection between the through holes or openings 28 and the terminals 210.

As the substrate engagement ends 226 of the substrate mating portions 216 are configured to either deform or exert pressure on the walls of the through holes or openings 28, the amount of force required to insert the terminals 210 in the through holes or openings 28 can be significant. It is, therefore, advantageous to provide a mechanism which protects the terminals 210 from damage and deformation as the substrate engagement ends 226 of the substrate mating portions 216 are inserted into the through holes or openings 28. The insertion tool 50 provides such a mechanism.

As the substrate engagement ends 226 of the substrate mating portions 216 are inserted in the through holes or openings 28, the shoulder engagement surfaces 239 of the substrate mating portions 216 of the terminals 210 engage the engagement surfaces 60 of the terminal insertion projections 56 of the insertion tool 50. In so doing, forces applied to the substrate mating portions 216 will be transferred to the insertion tool 50 through the engagement of the shoulder engagement surfaces 239 of the shoulders 232 with the engagement surfaces 60. Consequently, forces/stresses associated with mating the terminals 210 to the substrate or printed circuit board 30 are transferred to the insertion tool 50 rather than through the relatively weak bends of the transition portions 14 of the terminal 210.

The positioning of the shoulder engagement surfaces 239 of the substrate mating portions 216 of the terminals 210 outside the plane of the transition portions 14 allows the engagement surfaces 60 of the terminal insertion projections 56 of the insertion tool 50 to cooperate with the shoulder engagement surfaces 239 of the substrate mating portions 216 to ensure that a sufficient force can be applied to the terminals 210 to facilitate mating of the compliant terminals 210 to the circuit board 30. As the mating forces are transferred to the insertion tool 50, the terminals 210 are not damaged or deformed during mating, thereby providing a secure and reliable connection between the terminals 210 and the printed circuit board 30.

Figure 13:
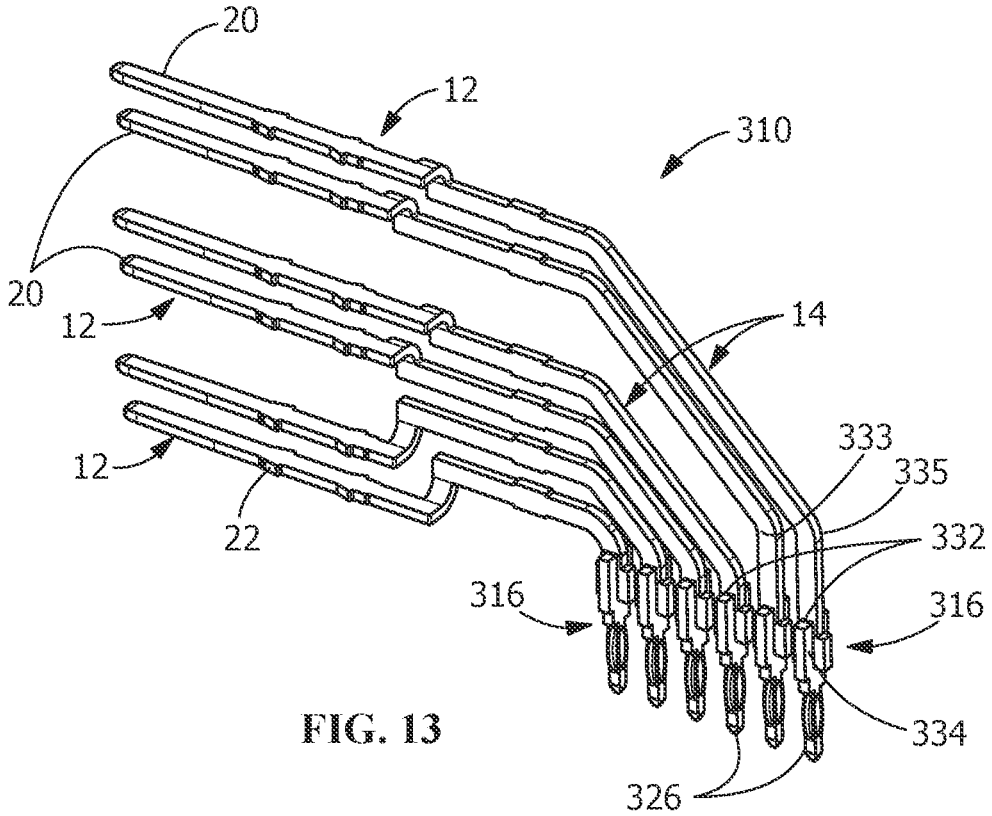
FIG. 13 is a perspective view of first alternate illustrative electrical terminals with insertion support sections according to the present invention.

As shown in the illustrative embodiment shown in FIG. 13 through 16, contacts or terminals 310 have connector mating portions 12, transition portions 14 and substrate mating portions 316. In FIG. 13, six different terminals 310 are shown with different transition portions 14. However, other configurations of the terminals 310 can be used. As the connector mating portions 12 and transition portions 14 are similar to those in FIGS. 1 through 4, the detailed description will not be repeated and is incorporated herein.

Figure 14:
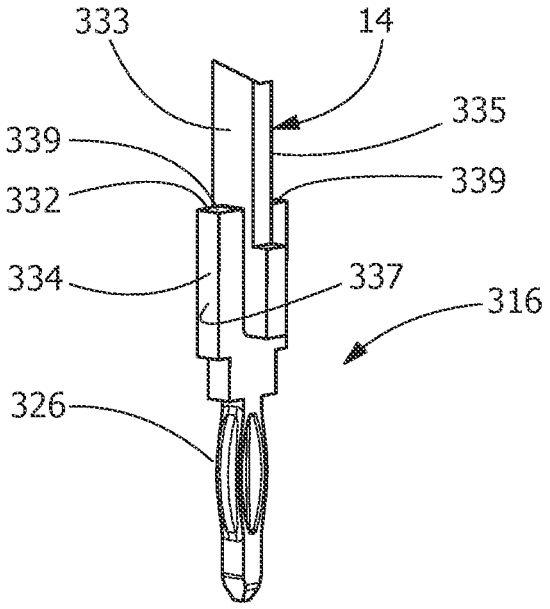
FIG. 14 is an enlarged perspective view of the insertion support section of an electrical terminal shown in FIG. 13.
Figure 15:
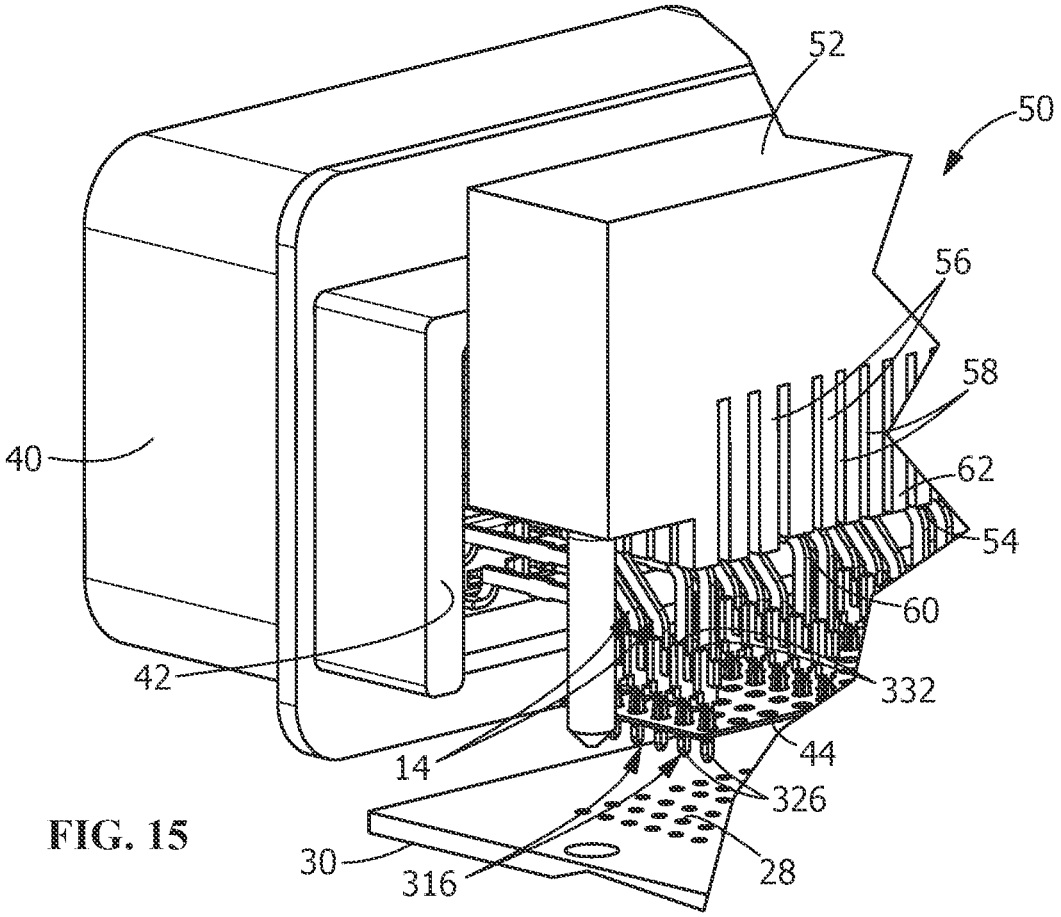
FIG. 15 is a perspective view of an illustrative header with the electrical terminals of FIG. 13 inserted therein, insertion tooling is positioned proximate to the electrical terminals.
Figure 16:
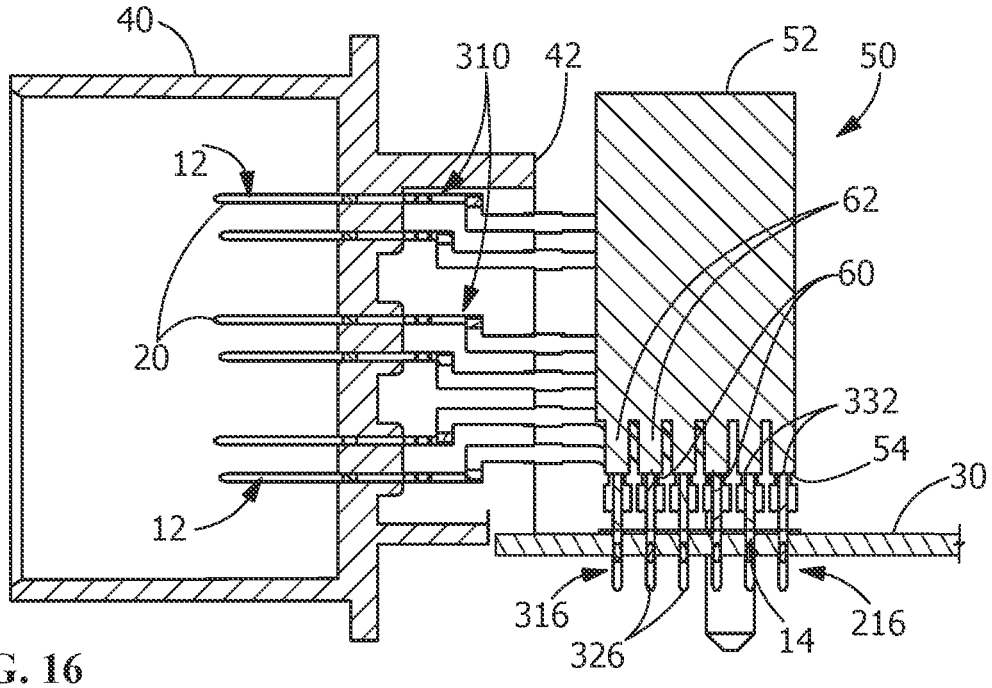
FIG. 16 is a cross-sectional view of the header of FIG. 15 with the insertion tooling in mechanical engagement with the insertion support sections of the electrical terminals.

As shown in FIGS. 13 and 14, the substrate mating portions 316 have substrate engagement ends 326 which are configured to be inserted into through holes or openings 28 of a substrate or printed circuit board 30 (FIGS. 15 and 16). In the embodiment shown, the substrate engagement ends 326 are compliant pins, such as for example, eye of the needle compliant pins. However, other type configuration can be used for the substrate engagement ends 326. The substrate mating portions 316 have projections 334 which form a generally U-shape as viewed in FIG. 14. The projections 334 have shoulders 332 spaced from the substrate engagement ends 326. The projections 334 and shoulders 332 extend outward from the plane of the substrate engagement ends 326. The shoulders 332 have shoulder engagement surfaces 339. The projections 334, the shoulders 332 and the shoulder engagement surfaces 339 are provided in a different plane than the longitudinal axis of the transition portions 14. In particular, respective shoulder engagement surfaces 339 extend from a front surface 333 of the substrate mating portions 316 in a direction away from a rear surface 335 of the substrate mating portions 316, while other respective shoulder engagement surfaces 339 extend from the rear surface 335 of the substrate mating portions 316 in a direction away from the front surface 333 of the substrate mating portions 316. In this embodiment, the substrate mating portions 316 are soldered or welded on to the transition portions 14, allowing the transitions portions 14 and the substrate mating portions 316 to be made of different materials.

As shown in FIG. 14, the thickness of material of each terminal 310 and the transition portion 14 is constant and extends between the front surface 333 and the rear surface 335. Each substrate mating portions 316, which is attached to a respective front surface 333 and a respective rear surface 335 of a respective transition portion 14 extends outside a plane of the transition portion 14. Consequently, the shoulders 332 and the shoulder engagement surfaces 339 are positioned outside a plane of the transition portion 14.

Referring to FIG. 15, the terminals 310 are shown inserted into the housing 40. When fully inserted into the housing 40, the securing projections 22 of the connector mating portions 12 engage the walls of the housing 40 to properly position and maintain the connector mating portions of the terminals 310 in the housing, as was previously described with respect to FIGS. 1 through 4.

As shown in FIG. 15, the insertion tool 50, as previously described, is provided above the transition portions 14 and the substrate mating portions 316 of the terminals 310. The engagement surfaces 60 of the insertion tool 50 are positioned to engage and cooperate with the shoulder engagement surfaces 339 of the substrate mating portions 316 of the terminals 310, as will be more fully described.

With the terminals 310 properly inserted into the housing 40 and the substrate engagement ends 26 properly positioned in-line with the through holes or openings 28 of the substrate or printed circuit board 30, the insertion tool 50 is moved from the initial position shown in FIG. 15 to the final position shown in FIG. 16.

In the initial position shown in FIG. 15, the terminal receiving slots 58 are aligned vertically with the transition portions 14 of the terminals. The terminal receiving slots 58 are dimensioned to be slightly wider than the width of the transition portions 14 of the terminals 310.

As the movement from the initial to the final position occurs, the terminal receiving slots 58 are moved over the transition portions 14 of the terminals 310. As the movement continues, the engagement surfaces 60 of the terminal insertion projections 56 are moved into engagement with the shoulder engagement surfaces 339 of the substrate mating portions 316. As the shoulder engagement surfaces 339 extend outside of the plane of the transition portions 14, the engagement surfaces 60 of the terminal insertion projections 56 of the insertion tool 50 are able to engage the shoulder engagement surfaces 339 of the substrate mating portions 316 while the transition portions 14 are maintained in the terminal receiving slots 58 of the insertion tool 50.

With the engagement surfaces 60 of the terminal insertion projections 56 of the insertion tool 50 in engagement with the shoulder engagement surfaces 339 of the substrate mating portions 316, the continued movement of the insertion tool 50 toward the final position causes the substrate engagement ends 326 of the substrate mating portions 316 to be moved or pushed by the engagement surfaces 60 of the terminal insertion projections 56 of the insertion tool 50 into the through holes or openings 28 of the substrate or printed circuit board 30 which are aligned therewith.

As the substrate engagement ends 326 of the substrate mating portions 316 of the terminals 310 are moved into the through holes or openings 28 of the substrate or printed circuit board 30, the substrate engagement ends 326 engage the walls of the through holes or openings 28 to provide a reliable electrical connection between the through holes or openings 28 and the terminals 310.

As the substrate engagement ends 326 of the substrate mating portions 316 are configured to either deform or exert pressure on the walls of the through holes or openings 28, the amount of force required to insert the terminals 310 in the through holes or openings 28 can be significant. It is, therefore, advantageous to provide a mechanism which protects the terminals 310 from damage and deformation as the substrate engagement ends 326 of the substrate mating portions 316 are inserted into the through holes or openings 28. The insertion tool 50 provides such a mechanism.

As the substrate engagement ends 326 of the substrate mating portions 316 are inserted in the through holes or openings 28, the shoulder engagement surfaces 339 of the substrate mating portions 316 of the terminals 310 engage the engagement surfaces 60 of the terminal insertion projections 56 of the insertion tool 50. In so doing, forces applied to the substrate mating portions 316 will be transferred to the insertion tool 50 through the engagement of the shoulder engagement surfaces 339 of the shoulders 332 with the engagement surfaces 60. Consequently, forces/stresses associated with mating the terminals 310 to the substrate or printed circuit board 30 are transferred to the insertion tool 50 rather than through the relatively weak bends of the transition portions 14 of the terminal 310.

The positioning of the shoulder engagement surfaces 339 of the substrate mating portions 316 of the terminals 310 outside the plane of the transition portions 14 allows the engagement surfaces 60 of the terminal insertion projections 56 of the insertion tool 50 to cooperate with the shoulder engagement surfaces 339 of the substrate mating portions 316 to ensure that a sufficient force can be applied to the terminals 310 to facilitate mating of the compliant terminals 310 to the circuit board 30. As the mating forces are transferred to the insertion tool 50, the terminals 310 are not damaged or deformed during mating, thereby providing a secure and reliable connection between the terminals 310 and the printed circuit board 30.

The embodiments shown and described are illustrative embodiments. Other embodiments in which the shoulders and shoulder engagement surfaces are in a different plane than a longitudinal axis of the transition portion can be used. For example, the substrate mating portion may be twisted relative to the transition portion to position the shoulder engagement surfaces in the different plane.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical terminal for use in an electrical connector, the electrical terminal comprising:

a connector mating portion configured to be positioned in a housing of the electrical connector;

a transition portion, a first end of the transition portion extending from the connector mating portion;

a substrate mating portion extending from a second end of the transition portion, the substrate mating portion having a longitudinal axis which extends in a different plane than a longitudinal axis of the transition portion, the substrate mating portion having a substrate engagement end provided at a free end of the substrate mating portion, the substrate mating portion is configured to be inserted into an opening of a substrate, a shoulder provided on the substrate mating portion, the shoulder having a shoulder engagement surface being spaced from the substrate engagement end, the shoulder engagement surface being in-line with the longitudinal axis of the substrate mating portion and outside a plane of the transition portion, the shoulder engagement surfaces being perpendicular to a front surface of the transition portion;

wherein as the substrate engagement end of the substrate mating portion is inserted in the opening, the shoulder engagement surface of the shoulder of the substrate mating portions engages an insertion tool, wherein forces associated with mating the electrical terminal to the substrate are transferred through the shoulder to the insertion tool.

2. The electrical terminal as recited in claim 1, wherein the connector mating portion has a mating end which is configured to mate with a mating terminal, the connector mating portion has a securing projection which is spaced from the mating end.

3. The electrical terminal as recited in claim 2, wherein the connector mating portion is bent relative to the transition portion, wherein a longitudinal axis of the connector mating portion is in a different plane than the longitudinal axis of the transition portion.

4. The electrical terminal as recited in claim 1, wherein the shoulder engagement surface is positioned in-line with the substrate engagement end.

5. The electrical terminal as recited in claim 1, wherein the substrate engagement end is a compliant pin.

6. The electrical terminal as recited in claim 1, wherein an angled member extends between the shoulder and the transition portion.

7. The electrical terminal as recited in claim 1, wherein the substrate mating portion is soldered on to the transition portion.

8. The electrical terminal as recited in claim 1, wherein the substrate mating portion and the transition portion are made of different materials.

9. An electrical connector comprising:

a housing for receiving electrical terminals therein;

the electrical terminals comprising:

transition portions, the transition portions positioned in the housing;

substrate mating portions extending from the transition portions and extending from a rear face of the housing, the substrate mating portions having substrate engagement ends configured to be inserted into openings of a substrate, projections extending from the substrate mating portions, the projections having shoulder engagement surfaces, first respective projections of the projections and the shoulder engagement surfaces of the first respective projection extend from front surfaces of the substrate mating portions in a direction away from rear surfaces of the substrate mating portions, second respective projections of the projections and the shoulder engagement surfaces of the second respective projections extend from the rear surfaces of the substrate mating portions in a direction away from the front surfaces of the substrate mating portions;

the substrate mating portions are attached to front surfaces and rear surfaces of the transition portions, wherein the shoulder engagement surfaces of the first respective projections and the shoulder engagement surfaces of the second respective projections are positioned outside of a plane of the transition portions;

wherein forces associated with mating the electrical terminals to the substrate are transferred through the shoulder engagement surfaces to an insertion tool used to move the terminals into the openings.

10. The electrical connector as recited in claim 9, wherein the substrate engagement ends are compliant pins.

11. The electrical connector as recited in claim 9, wherein the longitudinal axes of the substrate mating portions are in-line with the longitudinal axes of the transition portions.

12. The electrical connector as recited in claim 9, wherein the substrate mating portions are soldered on to the transition portions.

13. The electrical connector as recited in claim 9, wherein the substrate mating portions and the transition portions are made of different materials.

* * * * *